US011046402B2

(12) United States Patent
Meyer et al.

(10) Patent No.: US 11,046,402 B2
(45) Date of Patent: Jun. 29, 2021

(54) UNDERWATER VEHICLE, WHICH SWIVELS A DRIVE UPON IMMERSION INTO A BODY OF WATER

(71) Applicant: ATLAS ELEKTRONIK GMBH, Bremen (DE)

(72) Inventors: Dennis Meyer, Ganderkesee (DE); Detlef Lambertus, Osterholz-Scharmbeck (DE)

(73) Assignee: ATLAS ELEKTRONIK GMBH, Bremen (DE)

( * ) Notice: Subject to any disclaimer, the term of this patent is extended or adjusted under 35 U.S.C. 154(b) by 2 days.

(21) Appl. No.: 16/629,068

(22) PCT Filed: Jul. 12, 2018

(86) PCT No.: PCT/EP2018/068960
§ 371 (c)(1),
(2) Date: Jan. 7, 2020

(87) PCT Pub. No.: WO2019/012049
PCT Pub. Date: Jan. 17, 2019

(65) Prior Publication Data

US 2020/0223519 A1 Jul. 16, 2020

(30) Foreign Application Priority Data

Jul. 12, 2017 (DE) ..... 10 2017 115 606.2

(51) Int. Cl.
*B63G 8/16* (2006.01)
*B63G 8/00* (2006.01)
*B63G 8/08* (2006.01)

(52) U.S. Cl.
CPC ..... *B63G 8/16* (2013.01); *B63G 8/001* (2013.01); *B63G 8/08* (2013.01); *B63G 2008/004* (2013.01)

(58) Field of Classification Search
CPC .... B63G 2007/005; B63G 8/00; B63G 8/001; B63G 2008/002; B63G 2008/004;
(Continued)

(56) References Cited

U.S. PATENT DOCUMENTS 3,250,238 A 5/1966 Reder
5,505,155 A * 4/1996 Adams ..... B63G 8/16 114/338
(Continued)

FOREIGN PATENT DOCUMENTS

DE 102 06 273 A 8/2003
EP 0 385 827 A 9/1990
(Continued)

OTHER PUBLICATIONS

English Translation of International Search Report issued in PCT/EP2018/068960, dated Sep. 12, 2018 (dated Sep. 20, 2018).

*Primary Examiner* — Ajay Vasudeva
(74) *Attorney, Agent, or Firm* — thyssenkrupp North America, LLC

(57) ABSTRACT

An underwater vehicle may include a first propulsion element disposed on a first swivel holder, a first drive motor that is able to drive the first propulsion element, and a swivel mechanism that is able to move the first swivel holder relative to an outer hull of the underwater vehicle from a swiveled-in position into a swiveled-out position. The underwater vehicle can detect a given event automatically under water. In response to the detection of the event, the underwater vehicle may activate the swivel mechanism. The activated swivel mechanism may then move the first swivel holder into the swiveled-out position.

22 Claims, 4 Drawing Sheets

(58) Field of Classification Search
CPC ..... B63G 2008/005; B63G 2008/007; B63G 2008/008; B63G 8/08; B63G 8/14; B63G 8/16
See application file for complete search history.

(56) References Cited

U.S. PATENT DOCUMENTS

| | | | | |
|---|---|---|---|---|
| 6,118,066 | A | 9/2000 | Sirmalis | |
| 9,969,491 | B2 * | 5/2018 | Strayer | B64C 39/024 |
| 10,450,040 | B2 * | 10/2019 | Radford | B25J 9/0087 |
| 10,640,177 | B1 * | 5/2020 | Robertson | B63B 35/00 |
| 2017/0137101 | A1 | 5/2017 | Ayotte | |

FOREIGN PATENT DOCUMENTS

| | | | |
|---|---|---|---|
| FR | 2742120 | A | 6/1997 |
| GB | 2 281 538 | A | 3/1995 |
| GB | 2305411 | A | 4/1997 |
| WO | 2014067563 | A | 5/2014 |

* cited by examiner

UNDERWATER VEHICLE, WHICH SWIVELS A DRIVE UPON IMMERSION INTO A BODY OF WATER

CROSS REFERENCE TO RELATED APPLICATIONS

This application is a U.S. National Stage Entry of International Patent Application Serial Number PCT/EP2018/068960, filed Jul. 12, 2018, which claims priority to German Patent Application No. DE 10 2017 115 606.2, filed Jul. 12, 2017, the entire contents of both of which are incorporated herein by reference.

FIELD

The present disclosure generally relates to underwater vehicles, including unmanned underwater vehicles that can swivel a drive when immersed in a body of water.

BACKGROUND

In U.S. Pat. No. 6,118,066 there is described an unmanned underwater vehicle (unmanned, autonomous, undersea platform 10) which can be launched from a ship (surface vessel 50) or from an aircraft (airborne vessel 60) and can travel through the water. This underwater vehicle 10 has an outer hull (outer hull 10a) and its own drive, namely outlets (thruster outlet ports 30 and 32) for jets and batteries.

From US 20170137101 A1 there is likewise known an unmanned underwater vehicle (submersible craft 90) which comprises a hull (hull of the vessel) and a drive (thruster assembly 12) with a propeller (propeller shroud 22) and a motor (motor section 20). The drive can be moved to and fro relative to the hull between a swiveled-in position and a swiveled-out position. A swivel mechanism moves the drive accordingly, see FIG. 4 and FIG. 10.

GB 2281538 A discloses an unmanned underwater vehicle (submersible mineclearing vehicle 1) having two propellers 4A and 4B, each of which is mounted on a swivellably mounted arm (outrigger arms 5A and 5B). In each case, an actuator (actuators 9) is able to rotate a shaft (11A, 11B) and thereby move an arm 5A, 5B together with the propellers 4A, 4B to and fro relative to the hull of the underwater vehicle 1 between a retracted position and a deployed position, see FIG. 1A and FIG. 1B.

Thus a need exists for an underwater vehicle that can be transported with a reduced risk of damage and that is automatically able to perform a given function after being placed in a body of water.

DETAILED DESCRIPTION

Figure 1:
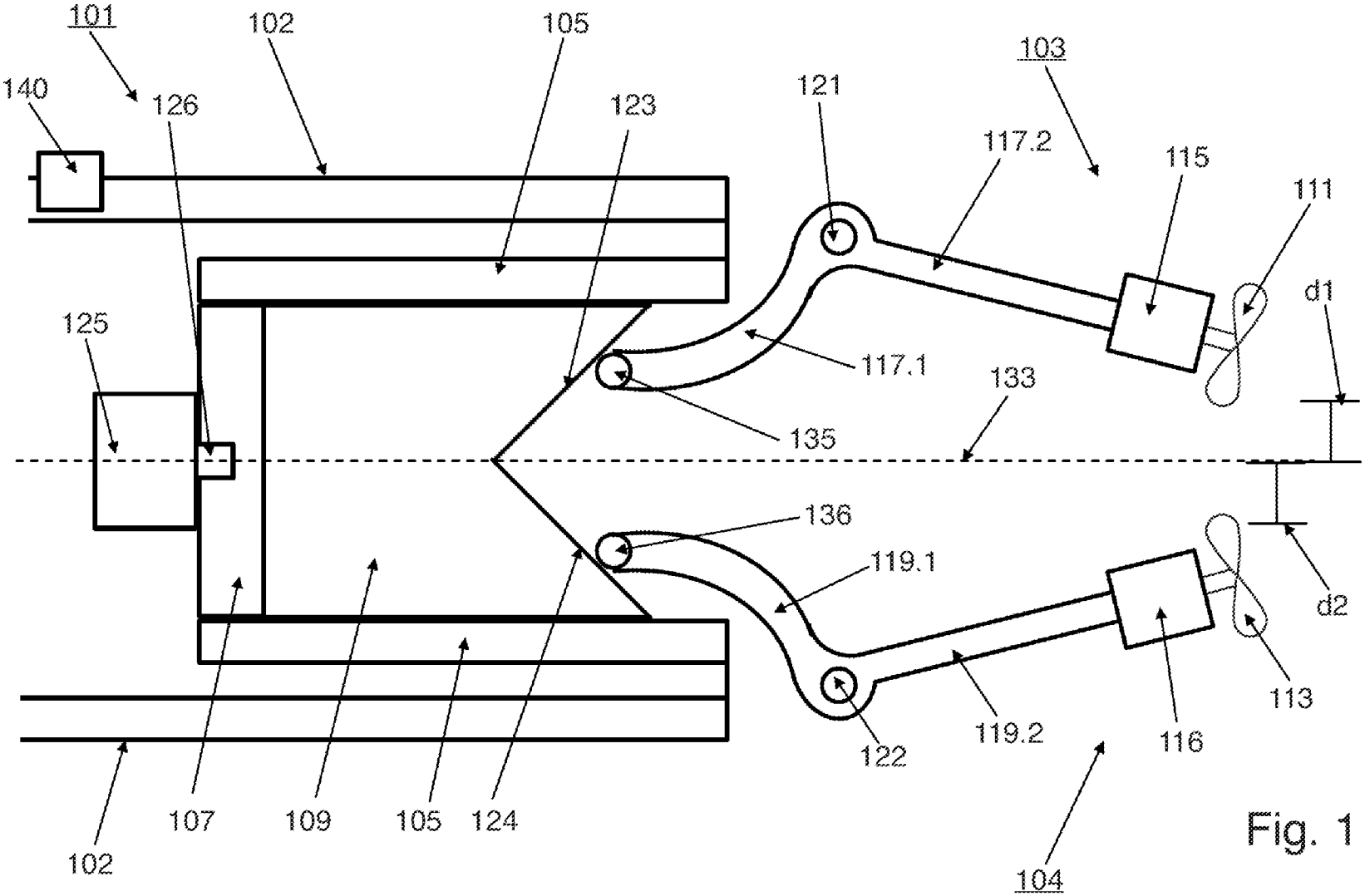
FIG. 1 is a schematic side view of an example autonomous underwater vehicle (AUV) in which assembly foam is used as expansion means, with two swivel holders in a swiveled-in position.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to underwater vehicles. In some examples, an underwater vehicle may include an outer hull and a swivel holder that is movable relative to the outer hull between a swiveled-in position and a swiveled-out position. In the swiveled-in position, the underwater vehicle is transportable. In the swiveled-out position, a propulsion element on the swivel holder can move the underwater vehicle through the water.

The underwater vehicle according to the invention comprises an outer hull,
a first swivel holder,
a first propulsion element,
a first drive motor, and
a swivel mechanism.

The outer hull extends along a longitudinal axis. The first propulsion element is able to move the underwater vehicle through the water and is arranged on the first swivel holder. The first drive motor is able to drive the first propulsion element.

The first swivel holder is movable relative to the outer hull, namely between a swiveled-in position and a swiveled-out position. These two positions can also be referred to as the retracted position and the deployed position, respectively. A distance occurs between the propulsion element and the longitudinal axis of the outer hull. This distance is dependent on the position of the first swivel holder. When the first swivel holder is in the swiveled-out position, the distance is larger than when the first swivel holder is in the swiveled-in position.

The swivel mechanism is able to move the first swivel holder from the swiveled-in position into the swiveled-out position, namely at least when the underwater vehicle is under water.

The underwater vehicle is automatically able to detect a given event underwater. In response to the detection of this given event, the underwater vehicle is able to activate the swivel mechanism automatically and under water. Activation of the swivel mechanism causes the first swivel holder to be moved from the swiveled-in position into the swiveled-out position.

By means of the method according to the solution, an underwater vehicle according to the solution can be operated. The method comprises the following steps:

The underwater vehicle is transported out of the water to a given operating site. During transportation, the first swivel holder is in the swiveled-in position.

The underwater vehicle is placed into the water. During this step, the first swivel holder remains in the swiveled-in position.

While or after the underwater vehicle is being or has been placed into the water, the underwater vehicle automatically detects a given event.

In response to the detection of this event, the underwater vehicle activates the swivel mechanism automatically and under water.

The activated swivel mechanism moves the first swivel holder into the swiveled-out position.

According to the solution, the distance between the first propulsion element and the longitudinal axis is smaller in the swiveled-in position than in the swiveled-out position. The underwater vehicle thus takes up less space in the swiveled-in position than in the swiveled-out position. This makes it easier to transport the underwater vehicle to an operating site. In particular on board an aircraft or surface vehicle which is used for transportation, there is frequently only little space. The swiveled-in position additionally reduces the risk of the first propulsion element protruding far beyond the outer hull and therefore injuring a living creature or colliding with an object outside the underwater vehicle.

In some applications, it is necessary to transport the underwater vehicle to the operating site and launch it there by means of an air vehicle, for example by means of a helicopter, an aircraft, an airship or a balloon. This is necessary in particular if a coastline is not easily accessible either by land or by water, a launching device cannot be installed on land and a floating transport platform cannot be used, for example because of swell or cliffs. The underwater vehicle according to the solution with the first swivel holder in the swiveled-in position takes up less space on board the air vehicle and therefore facilitates transport by air.

The invention further makes it possible for the first swivel holder to remain in the swiveled-in position and for the first propulsion element therefore to have the smaller distance relative to the longitudinal axis when the underwater vehicle is lowered into the water. In particular when the underwater vehicle is launched into the water from a relatively great height, considerable forces can occur when the launched underwater vehicle hits the surface of the water from above. In particular, there is the risk that a propeller or another component of the first propulsion element will be bent or otherwise damaged or even destroyed on striking the surface of the water. The swiveled-in position reduces the risk of the first propulsion element or the first drive motor or the first swivel holder being damaged. The area of contact on striking the surface of the water, and thus the risk of damage, is reduced because of the swiveled-in position.

According to the solution, the underwater vehicle is able to detect a given event automatically and under water. In response to the underwater vehicle detecting this event, the underwater vehicle automatically activates the swivel mechanism and moves the first swivel holder together with the first propulsion element into the swiveled-out position. By virtue of this embodiment, the underwater vehicle can operate completely autonomously once it has been placed in the water. The invention makes it unnecessary to provide a data link between the underwater vehicle and a spatially remote platform, for example the air vehicle or the surface vehicle which transports the underwater vehicle according to the solution to the operating site. A data link via a cable can limit the use of the underwater vehicle under water or also that of the spatially remote platform. Wireless communication under water often achieves only a limited data transfer rate and can be disrupted. The underwater vehicle according to the solution is able to activate the swivel mechanism even without such a data link.

The invention makes it possible to adapt the given event that is to be detected to a desired use of the underwater vehicle. For example, it is possible that the swivel mechanism moves the first swivel holder into the swiveled-out position in response to the event that the underwater vehicle has reached the water or has descended to a specific water depth. It is not necessary to adapt the height from which the underwater vehicle is launched to a desired use of the underwater vehicle. In addition, it is not necessary to measure beforehand an environmental condition which occurs under water in a given use area for the underwater vehicle, and to use that measured environmental condition for launching the underwater vehicle or to correspondingly program the underwater vehicle. Instead, the underwater vehicle according to the solution automatically determines when the swivel mechanism is to be activated, and then activates it.

The swivel mechanism is able to move the first swivel holder from the swiveled-in position into the swiveled-out position and thereby increase the distance of the first propulsion element from the longitudinal axis. It is possible that the longitudinal axis runs through the first propulsion element when the first swivel holder is in the swiveled-in position.

In one embodiment, the first swivel holder can be rotated about an axis or otherwise swiveled, wherein this swivel axis is preferably perpendicular to the longitudinal axis of the outer hull. In another embodiment, the length of the first swivel holder can be changed. The swivel mechanism is in this embodiment configured to increase the length of the first swivel holder and thereby move the first swivel holder into the swiveled-out position. These two embodiments can be combined.

According to the solution, the swivel mechanism is able to move the first swivel holder from the swiveled-in position into the swiveled-out position. In one embodiment, the swivel mechanism can move the first swivel holder from the swiveled-out position into the swiveled-in position again. In another embodiment, the swivel mechanism is only able to move the first swivel holder into the swiveled-out position once.

In a preferred embodiment, the swivel mechanism comprises an expansion means and a mechanical transmission device. In response to the detection of the event, the underwater vehicle automatically activates the expansion means. The expansion means causes the transmission device to move. The movement of the transmission device causes the first swivel holder to be moved from the swiveled-in position into the swiveled-out position.

This embodiment divides the swivel mechanism into two components, namely the activatable expansion means and the mechanical transmission device.

The activatable expansion means can be so configured that it occupies little space before activation and is arranged wholly inside the outer hull. This reduces the risk of the expansion means being activated during transportation or when the underwater vehicle is being placed into the water, which is undesirable. The outer hull additionally protects the expansion means from mechanical damage. It is possible to design the expansion means for single use, that is to say so that the expansion means causes a movement of the transmission device once.

The transmission device can be in the form of a purely passive mechanical transmission device, which in particular does not actively have to be activated and can be configured solely to convert a movement of the activated expansion means into a movement of the first swivel holder.

In one embodiment, the transmission device is linearly movable relative to the outer hull or comprises a linearly movable component. This embodiment makes it possible to guide the transmission device particularly well, for example by means of guide rails or another guide device, and thereby ensure with greater certainty that the first swivel holder is actually moved into the swiveled-out position. The transmission device comprises, for example, a piston which is linearly movable in a cylinder which is hollow on the inside. The cylinder guides the piston.

In one embodiment, a movement of the transmission device is transmitted to the first swivel holder as follows: A guide surface of the transmission device is perpendicular or at an angle to the longitudinal axis of the underwater vehicle and/or at an angle to the movement direction in which the transmission device is moved after activation of the expansion means. A component of the first swivel holder is in mechanical contact with this guide surface. A movement of the transmission device causes the first swivel holder to be moved into the swiveled-out position. The component of the first swivel holder that is in contact with the guide surface can move relative to the sloping guide surface. The component is thereby prevented from moving, and the first swivel holder is prevented from twisting or jamming as a result. This embodiment allows a linear movement of the transmission device to be converted into a swiveling movement of the first swivel holder.

In one embodiment, the transmission device comprises a piston which is linearly movable relative to the outer hull. A cone-shaped indentation is formed in the surface of the piston that faces towards the first swivel holder. This indentation provides the sloping guide surface.

In one embodiment, the transmission device is arranged in a cavity. The cavity is enclosed by a hollow body. The hollow body is located on the inside of the outer hull. This embodiment protects the transmission device particularly well from mechanical damage.

The expansion means can be an actuator, in particular a linear motor or a servomotor. A linear motor is able to cause a linear movement of a driven component, here of the transmission device. A servomotor is able to cause a controlled rotational movement.

The expansion means can comprise a propelling charge, for example a propelling charge in powder form. The propelling charge is ignited in order to activate the expansion means. The propelling charge takes up little space.

In one embodiment, the expansion means causes a fluid to flow into a cavity. This cavity is enclosed by a hollow body which is arranged on the inside of the outer hull. This fluid is preferably in operative connection with the transmission device and causes the movement of the transmission device. The use of a fluid allows the expansion means, in many applications, to be arranged in a particularly space-saving manner inside the underwater vehicle.

In one embodiment, the water which surrounds the underwater vehicle after it has been placed into the water is used as the or a fluid. For example, a flap in the outer hull of the underwater vehicle is opened and the water pressure, and in one embodiment additionally a pump, force the incoming water into a cavity. The incoming water moves the transmission device. It is also possible that the inflowing water initiates a chemical process which moves the transmission device. This embodiment removes the necessity to provide the fluid on board the underwater vehicle.

In another embodiment, the fluid is provided in a container on board the underwater vehicle. The container stores the fluid, preferably under overpressure. It is also possible that the fluid is a chemical substance or a composition of a plurality of chemical substances. Activation of the expansion means causes a process to be started which produces heat and/or leads to an expansion in volume of the fluid. In order to activate the expansion means, a closure member for an outlet of the container is opened. This outlet leads into the cavity. When the closure member is open, the fluid flows into the cavity, where it causes the displacement or other movement of the transmission device.

The fluid can be a gas which is stored under overpressure in the container and expands when it flows into the cavity. In one embodiment, the fluid cures in the cavity, that is to say becomes mechanically stable only after a curing time in the cavity. For example, the fluid is an assembly foam, which can comprise polyurethane. By means of this embodiment with the curing fluid, the transmission device is held in an end position. The first swivel holder is thereby held in the swiveled-out position. The first swivel holder is prevented from being moved back out of the swiveled-out position again, for example as a result of the flow of the surrounding water. The cured fluid produces this desired effect without an additional locking unit being required. The fluid thus has two effects: It moves the transmission device. It holds the first swivel holder in the swiveled-out position.

According to this embodiment, the fluid in the cavity is mechanically stable after curing. At least before curing, the fluid comprises, for example, isocyanate and polyol in an aerosol mixture. As soon as the fluid has left the container and has been admitted into the cavity, the fluid foams and reacts with the moisture in the air or with the moisture on the inside walls of the cavity. It is also possible that the liquid fluid in the container comprises two different components which react with one another in the cavity, wherein one component acts as a crosslinker and/or curing agent. These two components can be stored in two different containers and only react with one another when they are in the cavity.

In a further embodiment, the swivel mechanism comprises an expansion means and a transmission device. The expansion means comprises a cavity which is fluidically connected to the outer hull and can be closed by a closure member. The expansion means further comprises a substance which is in the cavity and expands or otherwise reacts chemically when it comes into contact with water. Therefore, the expansion means moves the transmission device when water comes into contact with the substance in the cavity. In order to activate the expansion means, the closure member for the fluid connection is opened. Then, when the underwater vehicle is in the water, the surrounding water passes through the opened fluid connection into the cavity and initiates the chemical reaction.

In one embodiment, the underwater vehicle comprises a locking unit which can be moved from a release position into a locking position. In the release position, the locking unit allows the first swivel holder to be moved. In the locking position, the locking unit mechanically locks the first swivel holder and thus prevents the first swivel holder from moving. The locking unit can act directly on the first swivel holder or alternatively on a component of the swivel mechanism, for example on the transmission device. The locking unit comprises a movable locking body, for example a wedge element, a catch, a securing bolt, a folding element, a clamping unit or a tensioning unit.

In a further development of this embodiment, the locking unit is able to lock the first swivel holder in the swiveled-in position. The locking unit thus prevents the first swivel holder from being unintentionally moved out of the swiveled-in position during transportation or when the underwater vehicle is being launched. In another further development, the locking unit is able to lock the first swivel holder in the swiveled-out position. The locking unit thus ensures that the first swivel holder remains in the swiveled-out position when the first propulsion element is moving the underwater vehicle through the water.

The first propulsion element can comprise a propeller or alternatively a water jet. The first propulsion element is preferably a machine which takes up mechanical work and delivers it, at least partly in the form of flow energy, to a surrounding fluid. The first propulsion element is preferably rotatably arranged on the first swivel holder. The axis of rotation of the first propulsion element can coincide with a longitudinal axis of the first swivel holder or be at an angle to the swivel holder longitudinal axis.

The first drive motor is preferably a machine which converts electrical, chemical or thermal energy into kinetic energy and thereby drives the first propulsion element.

In one embodiment, as well as the first propulsion element, the first drive motor is also mounted on the first swivel holder. The first propulsion element and the first drive motor are moved together with the first swivel holder into the swiveled-out position. This embodiment avoids the necessity of arranging a motor outside the first swivel holder and having to establish a drive connection between that motor outside the first swivel holder and the first propulsion element on the first swivel holder. Such a drive connection would often be unable to follow a movement of the first swivel holder.

In one embodiment, the first drive motor on the first swivel holder is an electric motor. A voltage source for supplying the electric motor is located in one embodiment outside the first swivel holder, for example in the outer hull, and does not have to be swiveled. A flexible electrical connection between the voltage source and the first drive motor is able to follow a movement of the first swivel holder. In a departure, the voltage source for supplying the electric motor is also arranged on the first swivel holder. This embodiment removes the need for a connection between a voltage source outside the first swivel holder and the first drive motor on the swivel holder.

In one embodiment, the first propulsion element is arranged at the stern of the underwater vehicle and propels the underwater vehicle in front of it. When the stern is viewed in a direction parallel to the longitudinal axis, the first propulsion element is located wholly or at least partially within the contour of the outer hull, even when the first swivel holder is in the swiveled-out position. The first propulsion element thus does not protrude laterally at all, or protrudes laterally only partially, beyond the outer contour of the underwater vehicle. This embodiment results in a low hydrodynamic resistance of the underwater vehicle under water.

In one embodiment, the underwater vehicle comprises in addition to the first swivel holder at least a second swivel holder. A second propulsion element is mounted on the second swivel holder. The swivel mechanism is able to move both swivel holders from the swiveled-in position into the swiveled-out position, preferably simultaneously and in a synchronized manner. Thus, at any time, either both swivel holders are in the swiveled-in position or both swivel holders are in the swiveled-out position. Two driven propulsion elements which are each offset laterally relative to the longitudinal axis are able to keep the underwater vehicle on course better than only a single propulsion element. In addition, a propulsion element is then still available if the other propulsion element has failed. The two propulsion elements may be of different forms.

It is possible that a total of three movable swivel holders carry three different propulsion elements. These three swivel holders are preferably so arranged that, in the swiveled-out position of all three swivel holders, there is an angle of in each case 120 degrees between two adjacent propulsion elements. This embodiment delivers the flow energy that is produced to the surrounding water particularly efficiently.

In one embodiment, the first swivel holder is so mounted that it can be swiveled about a first swivel axis. The first swivel axis is preferably perpendicular to the longitudinal axis. The first swivel holder comprises a first arm and a second arm which are preferably fixedly connected together. These two arms extend away from the first swivel axis in two different directions in the manner of a rocker. The first arm is operatively connected to the swivel mechanism. The second arm carries the first propulsion element.

By virtue of these embodiments, two levers can be produced, namely one lever for each arm of the first swivel holder. The length of each lever can be adapted to a desired and achievable force transmission and to the available space.

According to the solution, the underwater vehicle automatically detects a given event under water. The detection of this event initiates the step that the underwater vehicle automatically activates the swivel mechanism. In one embodiment, a sensor on board the underwater vehicle is able to detect a given environmental condition automatically under water. The detection of this environmental condition initiates the step of activating the swivel mechanism. This embodiment allows the use of the underwater vehicle to be adapted to a given condition, namely by configuring the sensor accordingly. The sensor need only be configured for use under water.

For example, the sensor is able automatically to detect at least one of the following events:

- The underwater vehicle has been immersed in a body of water. By virtue of this embodiment, the swivel mechanism is activated as soon as the underwater vehicle has reached the water, irrespective of the height from which it was launched.
- The underwater vehicle has reached a given water depth. This embodiment allows the underwater vehicle to descend in the water with the first swivel holder in the swiveled-in position and the swivel mechanism to be activated when the descending underwater vehicle has reached a given water depth. By virtue of this embodiment, the underwater vehicle quickly reaches a given water depth and then moves off.
- The sensor detects an object with given properties, for example a sea mine to be neutralized or a pipeline to be investigated, under water outside the underwater vehicle. This embodiment allows the underwater vehicle placed into the water to descend and/or be propelled to an object with given properties and then to move towards the object.
- The sensor detects that the underwater vehicle has descended to a sufficient depth that the distance between the underwater vehicle and the bottom of a body of water, for example the seabed, has fallen below a given limit. This embodiment allows the underwater vehicle to travel close to the bottom of a body of water without the underwater vehicle touching the bottom of the body of water. It is not necessary to measure the water depth to the bottom before the underwater vehicle is lowered.

In one embodiment, the underwater vehicle comprises a time switch. The time switch is activated, for example by a person, when the underwater vehicle is placed into the water. The time switch measures the event that a given time period since activation of the time switch has passed. The time switch then initiates the step of activating the swivel mechanism. This embodiment removes the need for a sensor on board the underwater vehicle.

In one embodiment, the first drive motor, which is able to drive the first propulsion element, remains switched off as long as the first swivel holder is in the swiveled-in position. This embodiment makes it possible to save electrical energy or another driving medium while the underwater vehicle is being transported to an operating site. The first drive motor is only switched on under water.

In one embodiment, the two steps of activating the swivel mechanism and switching on the first drive motor are carried out independently of one another. In a preferred embodiment, on the other hand, the step that the first swivel holder with the first propulsion element has reached the swiveled-out position or an intermediate position initiates the step of switching on the first drive motor. This embodiment removes the need for a separate switch-on mechanism for the first drive motor. In many cases, a contact switch is sufficient. It is ensured that the first drive motor is switched on as late as possible and as early as necessary. On the one hand, the first drive motor is prevented from driving the first propulsion unit while the first swivel holder is still in the swiveled-in position. On the other hand, it is ensured that the first propulsion element is driven when the first swivel holder is in the swiveled-out position.

The underwater vehicle can be, for example, a manned or unmanned submarine, an unmanned autonomous underwater vehicle (AUV, autonomous unmanned vehicle), a remote-controlled underwater vehicle (ROV, remotely operated vehicle), an underwater robot, an underwater glider or an underwater running body, for example a torpedo.

Figure 2:
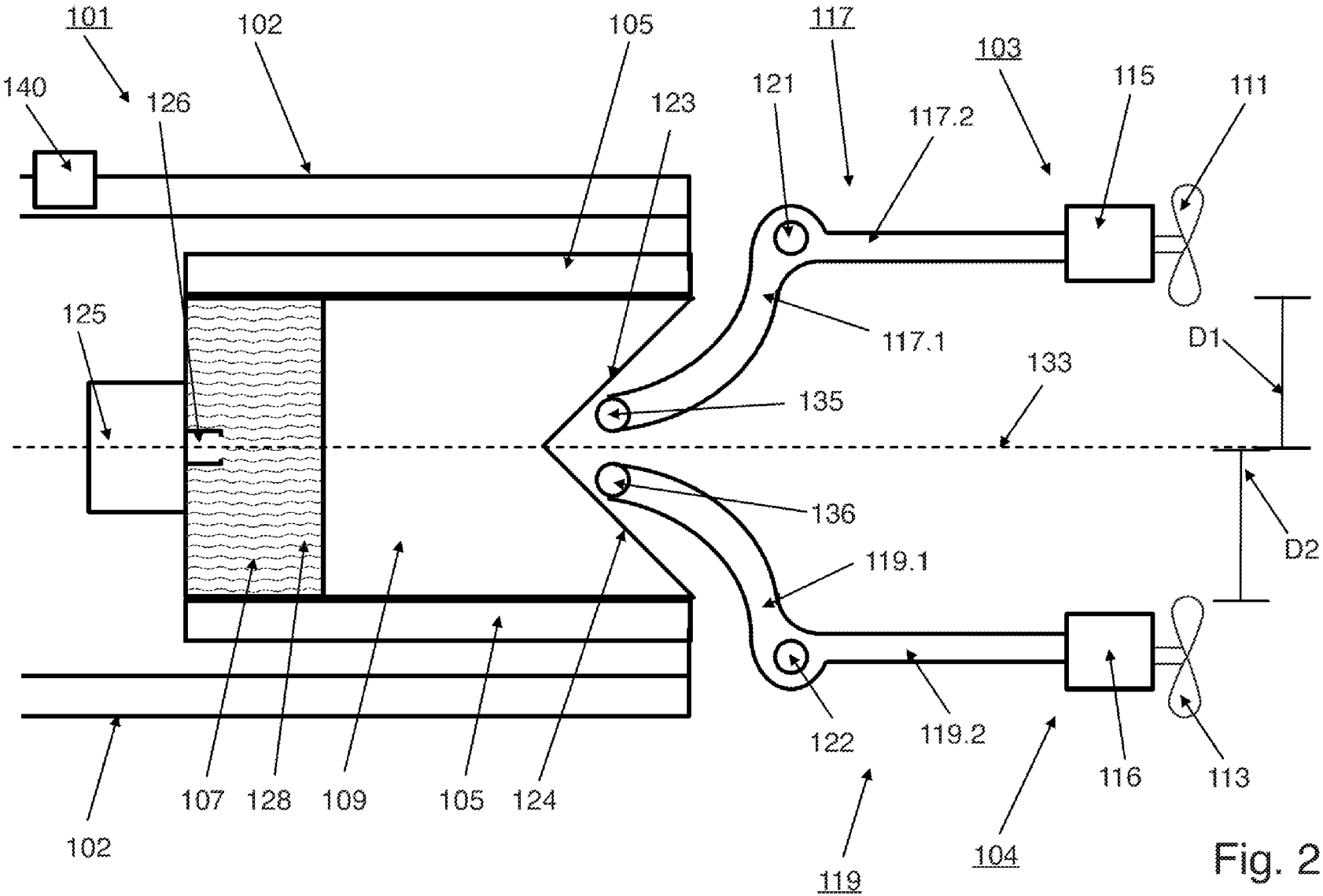
FIG. 2 is a schematic side view of the example AUV of FIG. 1, but with the two swivel holders in a swiveled-out position.
Figure 3:
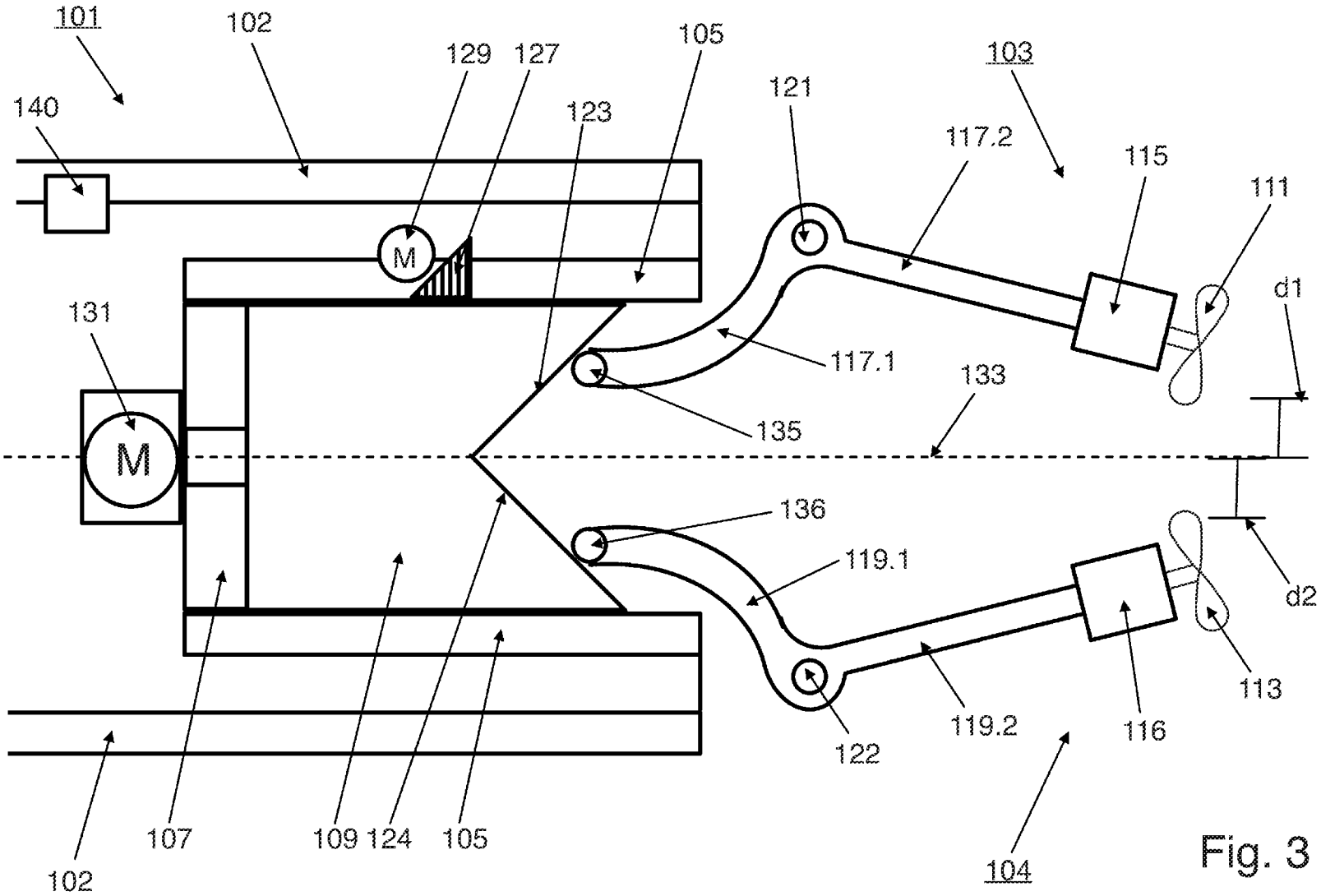
FIG. 3 is a schematic side view of another example AUV in which a linear motor is used as expansion means, with two swivel holders in a swiveled-in position.
Figure 4:
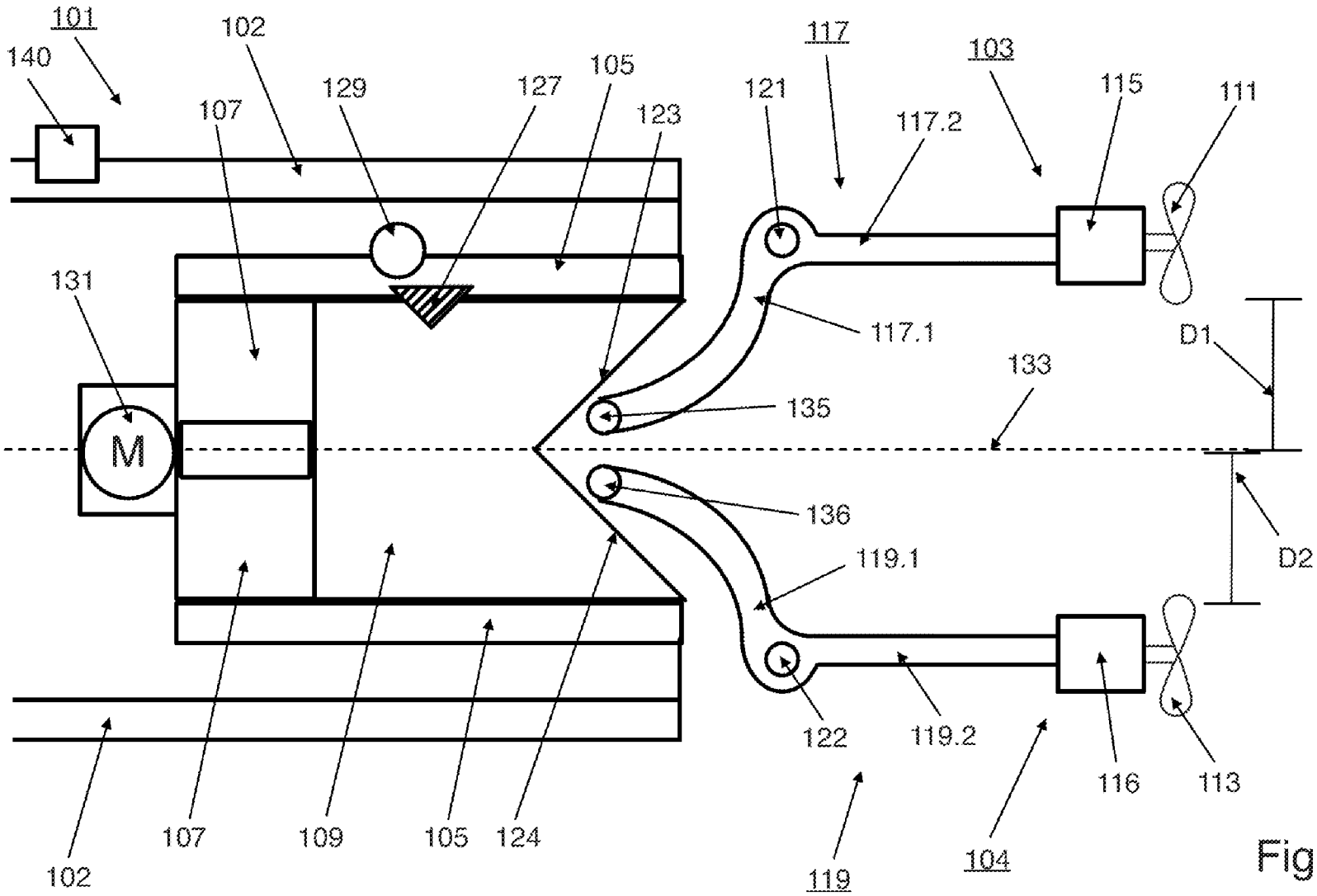
FIG. 4 is a schematic side view of the example AUV of FIG. 3 with the two swivel holders in a swiveled-out position.

The invention is explained hereinbelow with reference to two exemplary embodiments. FIG. 1 and FIG. 2 show the first exemplary embodiment, FIG. 3 and FIG. 4 show the second exemplary embodiment.

In both exemplary embodiments, the invention is used in an autonomous unmanned underwater vehicle (autonomous underwater vehicle, AUV) 101. The underwater vehicle 101 extends along a longitudinal axis 133 and has a cylindrical outer hull 102 and two drive devices 103 and 104 which are mounted at the stern. The outer hull 102 is rotationally symmetrical with respect to the longitudinal axis 133. The first drive device 103 comprises a first swivel holder 117, a first electric drive motor 115 and a first propeller 111. The second drive device 104 comprises a second swivel holder 119, a second electric drive motor 116 and a second propeller 113. It is also possible to use more than two drive devices 103 and 104, for example three drive devices, wherein the three swivel holders are arranged in a circle with an angle of in each case 120 degrees between two adjacent swivel holders.

In one embodiment, a voltage source (not shown) is arranged inside the outer hull 102, which voltage source is able to supply both electric drive motors 115 and 116 with electrical energy. A cable is guided from the voltage source to each of the drive motors 115 and 116. In another embodiment, an electrical voltage source for the drive motor 115 or 116 is additionally arranged on each swivel holder 117, 119.

Each drive device 103, 104 can be swiveled from a swiveled-in position into a swiveled-out position. The cable from the voltage source to the drive motor 115 or 116 follows this movement of the drive device 103, 104. If the voltage source is mounted on the swivel holder 117, 119, it is swiveled therewith.

FIG. 1 and FIG. 3 show the two drive devices 103 and 104 in the swiveled-in position, FIG. 2 and FIG. 4 show them in the swiveled-out position. When a drive device 103, 104 is in the swiveled-in position, there is a smaller distance d1, d2 between the propeller 111 or 113 and the longitudinal axis 133. In the swiveled-out position, there is a larger distance D1, D2. The first swivel holder 117 can be swiveled relative to the outer hull 102 about a first swivel axis 121, the second swivel holder 119 about a second swivel axis 122. The swivel axis 121, 122 is perpendicular to the longitudinal axis 133 and divides the associated swivel holder 117, 119 into two arms 117.1 and 117.2 and 119.1 and 119.2, which are fixedly connected together. The rear arm 117.2, 119.2 faces the stern of the underwater vehicle 101 and carries the drive motor 115, 116 and the propeller 111, 113. The front arm 117.1, 119.1 faces the bow of the underwater vehicle 101 and carries a series of guide rollers 135, 136.

In the swiveled-in position, each propeller 111, 113 and each drive motor 115, 116 is at a smaller distance d1, d2 from the longitudinal axis 133 compared to the swiveled-out position. At least in the swiveled-in position, each drive device 103, 104 is located wholly within an imaginary tube which is defined by the outer hull 102. It is possible that each drive device 103, 104 is also located wholly within that imaginary tube in the swiveled-out position. The underwater vehicle 101 thus has a comparatively low flow resistance when travelling through the water. In an alternative embodiment, each drive device 103, 104 at least partially protrudes laterally beyond the imaginary tube in the swiveled-out position. The propellers 111, 113 thereby achieve better thrust in many cases.

Inside the outer hull 102 there are arranged a tubular cylinder 105 which is hollow on the inside, and a piston 109. The piston 109 can be moved rearwards, that is to say towards the swivel axes 121 and 122, in the cylinder 105 along the longitudinal axis 133. The rear piston face of the piston 109 has a cone-shaped recess. By virtue of the cone-shaped recess, the piston 109 provides an upper sloping guide surface 123 and a lower sloping guide surface 124. The guide rollers 135 lie against the upper guide surface 123, the lower guide rollers 136 lie against the lower guide surface 124. A cavity 107 in the cylinder 105 adjoins the piston 109 at the front piston face of the piston 109.

A front closing wall closes the cavity 107.

When the drive device 103, 104 is in the swiveled-in position, the guide rollers 135 and 136 are at a larger distance from the longitudinal axis 133 and are close to the wall of the cylinder 105, see FIG. 1 and FIG. 3. If the piston 109 in the cylinder 105 is moved rearwards towards the swivel axes 121 and 122, the guide rollers 135, 136 roll or slide over the respective guide surface 123, 124 towards the longitudinal axis 133 and thus towards the tip of the cone-shaped recess. This movement forces the swivel holder 117, 119 to be rotated about the respective swivel axis 121, 122. The front arm 117.1, 119.1 is rotated towards the longitudinal axis 133, the rear arm 117.2, 119.2 is moved away from the longitudinal axis 133. The drive motor 115, 116 and the propeller 111, 113 are thus also moved away from the longitudinal axis 133. The two drive devices 103 and 104 are swiveled simultaneously and in a synchronized manner when the piston 109 is displaced rearwards.

The two exemplary embodiments differ by the mechanism which moves the piston 109 in the cylinder 105 rearwards, that is to say towards the swivel axes 121 and 122.

In the first exemplary embodiment, which is shown in FIG. 1 and FIG. 2, a cartridge 125 is mounted in front of the cylinder 105, which cartridge contains an assembly foam under overpressure. An outlet 126 of this cartridge 125 leads into the cavity 107. A closure member (not shown) for the outlet 126 can be transferred from a closed position, in which the closure member closes the outlet 126, into an open position, in which the closure member frees the outlet 126.

The drive devices 103 and 104 are initially in the swiveled-in position, and the closure member closes the outlet 126. As soon as the outlet 126 is freed, assembly foam 128 flows out of the cartridge 125 into the cavity 107 and expands. The cavity 107 is closed at the front by a closing wall. The expansion in volume of the assembly foam 128 in the cavity 107 therefore causes the piston 109 to be displaced rearwards. This forced displacement of the piston 109 rearwards causes the drive device 103 and 104 to be swiveled from the swiveled-in position into the swiveled-out position.

The assembly foam 128 cures in the cavity 107 and, after curing, holds the piston 109 in a rear end position. The two drive devices 103 and 104 are thereby held in the swiveled-out position. Because the assembly foam 128 in the cavity 107 has cured, it is generally not possible to bring the drive device 103 and 104 into the swiveled-in position again. In one embodiment, the guide rollers 135 and 136 or the piston 109 are additionally locked when the drive device 103 and 104 have reached the swiveled-out position.

In the second exemplary embodiment, a linear motor 131 is able to displace the piston 109 rearwards in the cylinder 105. In one embodiment, the linear motor 131 is additionally configured to displace the piston 109 forwards again in the cylinder 105. When the underwater vehicle 101 is being used under water, the water pressure of the surrounding water assists with the displacement of the piston 109 forwards, because the water pressure (dynamic pressure) strives to move the drive devices 103 and 104 into the swiveled-in position when the underwater vehicle is moving. A suitable unit (not shown), for example a plurality of spring elements or expansion units, ensures that the guide rollers 135 and 136 remain in contact with the guide surfaces 123 and 124. The drive devices 103 and 104 are thereby swiveled in a synchronized manner into the swiveled-in position again.

A locking wedge 127 is mounted in a swiveling manner in the cylinder 105. The locking wedge 127 can be swiveled to and fro between a locking position (FIG. 4) and a release position (FIG. 3). An actuator 129 is able to swivel the locking wedge 127 relative to the cylinder 105. As soon as the piston 109 has reached the rear position, the actuator 129 moves the locking wedge 127 into the locking position. It is thereby ensured that the drive devices 103 and 104 remain in the swiveled-out position. In order to allow the piston 109 to be displaced forwards again, the actuator 129 moves the locking wedge 127 into the release position again.

A preferred embodiment of how the underwater vehicle according to the solution is used is described hereinbelow. This embodiment can be used for both the embodiments of the swivel mechanism which have just been described.

The underwater vehicle 101 is transported to an operating site. During transportation, the two drive devices 103 and 104 are in the swiveled-in position. This reduces the risk of a component of a drive device 103 or 104 being damaged during transportation or of a living creature being injured or an object being damaged. Transport is carried out, for example, by means of an air vehicle or a surface vehicle (not shown). The drive motors 115, 116 of the drive devices 103 and 104 are switched off.

At the operating site, the underwater vehicle 101 is placed into the water, for example launched into the water from the air vehicle or the surface vehicle. The underwater vehicle 101 descends in the water. The drive devices 103 and 104 initially remain in the swiveled-in position, and the drive motors 115 and 116 remain switched off, while the underwater vehicle 101 is launched, strikes the surface of the water and descends in the water. By virtue of the swiveled-in position, the risk of a drive device 103 or 104 colliding with a living creature or an object outside the underwater vehicle 101 or of a component of a drive device 103 or 104 being damaged is reduced.

As soon as a defined event, which is described hereinbelow, has occurred, the following two operations are initiated in succession:

- The piston 109 is displaced rearwards in the cylinder 105 and swivels the two drive devices 103 and 104 in a synchronized manner from the swiveled-in position into the swiveled-out position.
- The two drive motors 115 and 116 are switched on, preferably at the same time, and rotate the two propellers 111 and 113.

In one embodiment, the operation of displacing the piston 109 rearwards is initiated first. The event that the two drive devices 103, 104 have reached a given position, for example the swiveled-out position or an intermediate position between the swiveled-in position and the swiveled-out position, is detected automatically. For example, a contact switch is activated. The detection of this event initiates the operation of switching on the two drive motors 115 and 116. This embodiment rules out the undesirable event of the drive motors 115 and 116 being switched on too early and the propellers 111 and 113, for example, touching.

In one embodiment, a time switch is activated as soon as the underwater vehicle 101 is launched, that is to say even before it reaches the water. The time switch automatically detects the event that a given time period after activation of the time switch has passed. As soon as this given time period has passed, the time switch—or a control device (not shown) of the underwater vehicle 101—automatically activates the expansion means 125, 131, which displaces the piston 109 rearwards. This embodiment leads to a particularly simple implementation.

In another embodiment, a sensor 140 is mounted on board the underwater vehicle 101, which sensor measures a value which is correlated with the descent of the underwater vehicle 101 in the water and/or with an environmental condition. For example, the sensor 140 measures the event that the underwater vehicle 101 has reached the water, a measurement of the current water depth in which the underwater vehicle 101 is located, or a measurement of the distance of the descending underwater vehicle 101 from the bottom of a body of water. Or the sensor 140 detects an object in the vicinity of the descending underwater vehicle 101. As soon as the sensor 140 has detected that a given event has occurred, the sensor 140 or the control device of the underwater vehicle 101 activates the expansion means, which displaces the piston 109 rearwards. It is possible that a plurality of sensors are arranged on board the underwater vehicle 101, wherein each sensor is able to detect a given event. As soon as at least one given event has occurred, the expansion means is activated.

REFERENCE NUMERALS

101 autonomous unmanned underwater vehicle
102 outer hull of the underwater vehicle 101
103 first drive device, comprises the first swivel holder 117, the first drive motor 115 and the first propeller 111
104 second drive device, comprises the second swivel holder 119, the second drive motor 116 and the second propeller 112
105 cylinder, in which the piston 109 is displaceably mounted
107 cavity inside the cylinder 105, adjoins the piston 109
109 piston, displaceably mounted in the cylinder 105
111 first propeller, mounted on the first swivel holder 117, rotated by the first drive motor 115
113 second propeller, mounted on the second swivel holder 119, rotated by the second drive motor 116
115 first drive motor, rotates the first propeller 111
116 second drive motor, rotates the second propeller 113
117 first swivel holder, carries the first drive motor 115 and the first propeller 111, comprises the arms 117.1, 117.2
117.1 front arm of the first swivel holder 117
117.2 rear arm of the first swivel holder 117
119 second swivel holder, carries the second drive motor 116 and the second propeller 113, comprises the arms 119.1, 119.2
119.1 front arm of the second swivel holder 119
119.2 rear arm of the second swivel holder 119
121 swivel axis, about which the first swivel holder 117 can be rotated
122 swivel axis, about which the second swivel holder 119 can be rotated
123 upper guide surface of the piston 109, guides the guide rollers 135 on the first swivel holder 117
124 lower guide surface of the piston 109, guides the guide rollers 136 on the second swivel holder 119
125 assembly foam cartridge, contains the assembly foam 128
126 outlet of the cartridge 125, leads into the cavity 107
127 locking wedge mounted in a swiveling manner, able to lock the piston 109
128 assembly foam in the cavity 107
129 actuator, able to swivel the locking wedge 127
131 linear motor, able to displace the piston 109 in the cylinder 105
133 longitudinal axis of the unmanned underwater vehicle 101
135 guide rollers at the front end of the first swivel holder 117, are guided by the guide surface 123
136 guide rollers at the front end of the second swivel holder 119, are guided by the guide surface 124
140 sensor for measuring an environmental condition
d1 distance between the propeller 111 and the longitudinal axis 133 when the drive device 103 is in the swiveled-in position
d2 distance between the propeller 113 and the longitudinal axis 133 when the drive device 104 is in the swiveled-in position
D1 distance between the propeller 111 and the longitudinal axis 133 when the drive device 103 is in the swiveled-out position
D2 distance between the propeller 113 and the longitudinal axis 133 when the drive device 104 is in the swiveled-out position

What is claimed is:

1. An underwater vehicle comprising:
an outer hull that extends along a longitudinal axis;
a first propulsion element disposed on a first swivel holder, wherein the first swivel holder is movable relative to the outer hull between a swiveled-in position and a swiveled-out position, wherein a distance between the first propulsion element and the longitudinal axis is smaller with the first swivel holder in the swiveled-in position than in the swiveled-out position;
a first drive motor that is configured to drive the first propulsion element; and
a swivel mechanism configured to move the first swivel holder together with the first propulsion element from the swiveled-in position into the swiveled-out position, wherein the swivel mechanism comprises:
expansion means that is activatable, and
a transmission device that is mechanical and is movable relative to the outer hull, wherein activation of the expansion means causes movement of the transmission device, wherein movement of the transmission device causes swiveling of the first swivel holder into the swiveled-out position,
wherein the underwater vehicle is configured, automatically underwater, to detect an event and to activate the swivel mechanism in response to detection of the event, wherein activation of the swivel mechanism causes movement of the first swivel holder from the swiveled-in position into the swiveled-out position.

2. The underwater vehicle of claim 1 wherein the transmission device is linearly movable relative to the outer hull, wherein activation of the expansion means causes a linear movement of the transmission device.

3. The underwater vehicle of claim 1 wherein the transmission device comprises a guide surface disposed at an angle relative to the longitudinal axis, wherein the first swivel holder comprises a component that is in mechanical contact with the guide surface, wherein movement of the transmission device causes movement of the first swivel holder relative to the outer hull and movement of the component relative to the guide surface, wherein a relative movement of the component causes or allows swiveling of the first swivel holder into the swiveled-out position.

4. The underwater vehicle of claim 3 wherein the transmission device comprises a piston that is movable relative to the outer hull, wherein the guide surface comprises a cone-shaped indentation of the movable piston.

5. The underwater vehicle of claim 1 comprising a hollow body that encloses a cavity, the hollow body being disposed inside the outer hull, wherein at least part of the transmission device is disposed in the cavity of the hollow body.

6. The underwater vehicle of claim 5 wherein the transmission device comprises a piston that is disposed in the cavity and is linearly movable relative to the hollow body.

7. The underwater vehicle of claim 1 wherein a hollow body that encloses a cavity is disposed inside the outer hull, wherein the underwater vehicle is configured after activation of the expansion means to cause a fluid to flow into the cavity, wherein a flow of the fluid into the cavity causes movement of the transmission device.

8. The underwater vehicle of claim 7 wherein the fluid comprises water that surrounds the underwater vehicle when immersed.

9. The underwater vehicle of claim 7 wherein the expansion means comprises a container with an outlet, wherein the outlet comprises a closure member and opens into the cavity, wherein the fluid is contained in the container, wherein the underwater vehicle is configured after activation of the expansion means to fulfill the closure member for the outlet, wherein the expansion means is configured such that when the closure member is open the fluid in the container flows into the cavity and causes movement of the transmission device.

10. The underwater vehicle of claim 9 wherein the expansion means is configured such that the fluid cures in the cavity.

11. The underwater vehicle of claim 1 wherein the first drive motor is disposed on the first swivel holder.

12. The underwater vehicle of claim 1 wherein the first propulsion element is disposed at a stern of the underwater vehicle, wherein at least when the first swivel holder is in the swiveled-out position the first propulsion element is disposed at least partially behind a contour of the outer hull when viewed in a direction parallel to the longitudinal axis.

13. The underwater vehicle of claim 1 comprising:

a second swivel holder; and a second propulsion element disposed on the second swivel holder, wherein the second swivel holder is movable relative to the outer hull between a swiveled-in position and a swiveled-out position, wherein the swivel mechanism is configured to move the first swivel holder and the second swivel holder, together with the first and second propulsion elements on the first and second swivel holders, from the swiveled-in positions to the swiveled-out positions in a synchronized manner.

14. The underwater vehicle of claim 1 wherein the first swivel holder is configured to be swiveled about a first swivel axis, wherein the first swivel holder comprises two arms that are mechanically connected together and extend away from the first swivel axis in different directions, wherein a first of the two arms is in operative connection with the swivel mechanism, wherein the first propulsion element is disposed on a second of the two arms.

15. The underwater vehicle of claim 1 comprising a sensor that is configured to detect an environmental condition automatically underwater, wherein the underwater vehicle is configured to activate the swivel mechanism automatically in response to detection of the environmental condition.

16. The underwater vehicle of claim 15 wherein the sensor is configured to automatically detect at least one of the following events:

immersion of the underwater vehicle in a body of water;

the underwater vehicle reaching a given water depth;

a distance between the underwater vehicle and a bottom of the body of water has fallen below a threshold; or an object with given properties has been detected outside the underwater vehicle, wherein the swivel mechanism is activated automatically upon detection of one or more of the events.

17. The underwater vehicle of claim 1 comprising an activatable time switch that is configured to detect an event where a given time period after activation of the time switch has passed, wherein the underwater vehicle is configured to activate the swivel mechanism in response to the event.

18. The underwater vehicle of claim 1 configured such that the first drive motor is switched off when the first swivel holder is in the swiveled-in position, wherein the underwater vehicle is configured to switch on the first drive motor in response to an event that the first swivel holder has reached the swiveled-out position or an intermediate position.

19. A method for operating an underwater vehicle, wherein the underwater vehicle comprises an outer hull that extends along a longitudinal axis; a first propulsion element disposed on a first swivel holder, wherein the first swivel holder is movable relative to the outer hull between a swiveled-in position and a swiveled-out position, wherein a distance between the first propulsion element and the longitudinal axis is smaller with the first swivel holder in the swiveled-in position than in the swiveled-out position; a first drive motor that is configured to drive the first propulsion element; and a swivel mechanism that includes expansion means that is activatable and a transmission device that is mechanical and is movable relative to the outer hull, the method comprising:

transporting the underwater vehicle out of water to an operating site with the first swivel holder in the swiveled-in position;

placing the underwater vehicle into the water with the first swivel holder in the swiveled-in position;

detecting an event automatically underwater with the underwater vehicle and in response to detection of the event activating the swivel mechanism, wherein activating the swivel mechanism comprises activating the expansion means, the expansion means moving the transmission device, and the transmission device moving the first swivel holder from the swiveled-in position into the swiveled-out position; and moving the underwater vehicle through the water with the first swivel holder in the swiveled-out position.

20. The method of claim 19 wherein a hollow body that encloses a cavity is disposed inside the outer hull, wherein activating the expansion means comprises initiating an event that a fluid flows into the cavity, wherein inflow of the fluid into the cavity causes the transmission device to be moved.

21. The method of claim 19 wherein after the underwater vehicle is placed in the water a sensor onboard the underwater vehicle automatically detects an environmental condition, wherein detection of the environmental condition initiates activation of the swivel mechanism.

22. An underwater vehicle comprising:

an outer hull that extends along a longitudinal axis;

a first propulsion element disposed on a first swivel holder, wherein the first swivel holder is movable relative to the outer hull between a swiveled-in position and a swiveled-out position, wherein a distance between the first propulsion element and the longitudinal axis is smaller with the first swivel holder in the swiveled-in position than in the swiveled-out position;

a first drive motor that is configured to drive the first propulsion element;

a swivel mechanism configured to move the first swivel holder together with the first propulsion element from the swiveled-in position into the swiveled-out position, wherein the underwater vehicle is configured, automatically underwater, to detect an event and to activate the swivel mechanism in response to detection of the event, wherein activation of the swivel mechanism causes movement of the first swivel holder from the swiveled-in position into the swiveled-out position; and a locking unit, wherein in a locking position the locking unit locks the swivel mechanism and prevents the first swivel holder from swiveling, wherein in a release position the locking unit allows the first swivel holder to swivel.

* * * * *